US007886486B2

(12) United States Patent
Lomax et al.

(10) Patent No.: US 7,886,486 B2
(45) Date of Patent: Feb. 15, 2011

(54) ADJUSTABLE PET DOOR HAVING REMOVABLE DECORATIVE FRAMES

(75) Inventors: Frederick K. Lomax, Rainier, WA (US); Linda G McCalum, Rainier, WA (US); Clark Berg Foster, Mission Viejo, CA (US)

(73) Assignee: Classy Custom Inc., Rainier, WA (US)

( * ) Notice: Subject to any disclaimer, the term of this patent is extended or adjusted under 35 U.S.C. 154(b) by 898 days.

(21) Appl. No.: 11/719,845

(22) PCT Filed: Nov. 22, 2005

(86) PCT No.: PCT/US2005/042588

§ 371 (c)(1),
(2), (4) Date: May 21, 2007

(87) PCT Pub. No.: WO2006/058148

PCT Pub. Date: Jun. 1, 2006

(65) Prior Publication Data

US 2009/0049753 A1 Feb. 26, 2009

(51) Int. Cl.
*E06B 7/28* (2006.01)

(52) U.S. Cl. ..... 49/169; 49/505; 119/484

(58) Field of Classification Search ..... 049/168, 049/169, 171, 505; 119/484; 052/217
See application file for complete search history.

(56) References Cited

U.S. PATENT DOCUMENTS 2,080,555 A * 5/1937 Beil et al. ..... 52/211
3,044,130 A * 7/1962 Mehalfy ..... 49/67
4,651,793 A * 3/1987 Davlantes ..... 160/92
4,888,924 A * 12/1989 Grisham et al. ..... 52/217
5,269,097 A 12/1993 Davlantes
5,458,088 A 10/1995 Owens
5,786,044 A 7/1998 Hauge
5,946,856 A * 9/1999 Davlantes ..... 49/168

(Continued)

FOREIGN PATENT DOCUMENTS

CA 2169385 9/1997

(Continued)

OTHER PUBLICATIONS

Text of First Office Action of China State Intellectual Property Office (Translation) for Application No. 200580039952.3 dated Apr. 17, 2009.

(Continued)

*Primary Examiner*—Gregory J. Strimbu
(74) *Attorney, Agent, or Firm*—Loeb & Loeb LLP

(57) ABSTRACT

An adjustable pet door having decorative and customizable aesthetic features. The pet door includes subframe assemblies that are connected to each other with fasteners that extend through an aperture defined by a door. The pet door can be adjusted to fit doors of various sizes by varying the number of module core frames disposed between the subframe assemblies. The core frames extend laterally between the subframe assemblies and define a passageway through the door. Decorative frames are releasably attached to the subframe assemblies and can be removed or replaced without having to remove the subframe assemblies from the door. A security panel can be secured to one of the subframe assemblies to prevent animals and intruders from entering a residence through the pet door.

19 Claims, 12 Drawing Sheets

U.S. PATENT DOCUMENTS

| | | | | |
|---|---|---|---|---|
| 6,125,581 | A * | 10/2000 | Grossman | 49/74.1 |
| 6,385,909 | B1 * | 5/2002 | Marsh et al. | 49/169 |
| 6,681,524 | B1 | 1/2004 | Tillson | |
| 7,063,123 | B2 * | 6/2006 | Lethers | 160/180 |
| 7,152,371 | B2 * | 12/2006 | Vaccari et al. | 49/169 |

FOREIGN PATENT DOCUMENTS

| | | | |
|---|---|---|---|
| GB | 2310248 | 8/1997 | |
| WO | WO 03/052230 | * | 6/2003 |

OTHER PUBLICATIONS

Second Office Action of China State Intellectual Property Office (Translation) for Application No. 200580039952.3 dated Jan. 15, 2010.

European Search Report for Application No. 05849570.6 dated Oct. 15, 2008.

Extended European Search Report for Application No. 05849570.6 dated Aug. 4, 2008.

Comments on First Examination Report New Zealand Patent Application No. 555461, dated May 29, 2009.

* cited by examiner

ADJUSTABLE PET DOOR HAVING REMOVABLE DECORATIVE FRAMES

CROSS-REFERENCE TO RELATED APPLICATION

This application claims priority of PCT/US2006/042588, filed Nov. 22, 2005, which claims priority of U.S. Provisional Application No. 60/630,708, filed Nov. 23, 2004. Both applications are incorporated herein by reference to the extent permitted by law.

TECHNICAL FIELD

The invention relates to pet doors and, more particularly, to a decorative and aesthetically pleasing, adjustable pet door that can be installed in residence doors of pet owners having different thicknesses, allowing a pet owner to customize the outer frames of the pet door, while substantially preventing cold, rain, stray pets and uninvited intruders from entering the pet owner's residence by use of a locking mechanism.

BACKGROUND ART

It is known to install an opening or pet door in a door of a residence to enable a pet to easily leave and return to the residence without intervention by the pet owner. Known pet doors are typically installed within an opening that is cut out of the pet owner's residence door or wall. In many cases, these known pet door components are designed to be nailed or screwed into the residence door, thus complicating installation of the pet door. Further, known pet doors may not fit all residence doors, which typically have different thicknesses and other custom properties.

In cases where a pet door is properly installed within an aperture formed in the residence door, the passageway that is created to allow a pet to leave and enter the residence has been known to create certain problems. For example, weather conditions, such as rain and cold, are known to enter the pet owner's residence via the passageway even when the pet door is not being used by the pet for entry or exit. Moreover, making the passageway through the pet door relatively large, to be able to accommodate large pets, may pose a security problem for the pet owner. In some cases, stray animals have been known to enter the pet owner's residence via the pet door. In other cases, small children and other human intruders might be able to fit through the passageway to gain access to the pet owner's residence.

Further, known pet doors typically appear bland and are generally aesthetically unappealing, particularly when added to certain decorative residence doors or residence doors that are adjacent to decorative interior or exterior sections of a residence. Thus, these known pet doors may detract from the exterior and interior décor, not match or be misplaced relative to the residential facade. For example, a typical pet door includes square frames fixed to the residence door with screws, nails or other fasteners. Further, typical pet doors do not allow residence owners the ability to make stylistic changes to the pet door following its installation.

Accordingly, known pet doors can be improved. There is a need for pet doors that are adjustable to fit residence doors having various thicknesses and adjustable or customizable to fit the openings formed in those residence doors and the residential facade. Providing adjustable pet doors would greatly increase the desirability and applicability of pet doors.

It is desirable to provide the pet door with an aesthetically pleasing appearance. It is also desirable for the pet owner to be able to substitute or change one decorative feature of the pet door for another in order to vary the style, color or architectural shape of the pet door to match the residential facade.

Moreover, there is an associated need for a pet door that also provide security features so that the pet door can be closed and secured. For example, when the pet is to remain inside or when the pet door is not in use to guard against intruders, children, and other animals passing through the pet door.

Pet door installation components and techniques can also be improved. In particular, it should not be necessary to drill holes in a residence door or insert fasteners into a residence door since installing pet doors in these conventional manners complicates the installation.

DISCLOSURE OF INVENTION

A pet door is disclosed to be installed in a residence door of a pet owner so as to overcome the disadvantages of known pet doors. That pet door includes a subframe assembly that is attached or otherwise fixed to the residence door and defines a passageway through which pets can leave and return to the pet owner's residence. In some embodiments, decorative frames may be attached to subframe assembly that is fixed to the residence door. These decorative frames may be attached to the frame portion inside or outside the residence. The interior and exterior decorative frames can have the same or different ornamental appearance and can be interchanged or replaced to match various designs, decorations, styles, tastes and décor. Thus, the appearance of the pet door can be customized to match the taste of the pet owner or to match the decor of his residence using different decorative frames without changing the subframe assembly.

A subframe assembly defines an aperture in the residence door and can be adjusted with core frame members, which are removed or added as necessary so that the pet door can be used with residence doors having various thicknesses. In particular, core frame members may be added or removed from subframes to adapt the pet door to residence doors of different thicknesses. A movable flap covers the open passageway formed by the subframe. The bottom and sides of the movable flap preferrably carry magnets and/or ferrous magnetically active materials that cooperate with opposing magnets and/or ferrous magnetically active materials located around the subframe assembly so that the bottom and sides of the movable flap can be reliably held in place to close the passageway and thereby substantially prevent cold, rain and other weather conditions from entering the pet owner's residence when the pet door is not in active use. A removable security panel may also be provided to be positioned across the open passageway. A locking mechanism, such as a deadbolt lock, is slidable into and out of the pet door subframe elements to prevent the unauthorized removal of the security panel, so as to prevent stray pets and uninvited intruders from gaining access to the pet owner's residence.

BRIEF DESCRIPTION OF DRAWINGS

Referring now to the drawings, in which like reference numbers represent corresponding parts throughout, and in which.

MODES FOR CARRYING OUT THE INVENTION

Figure 1:
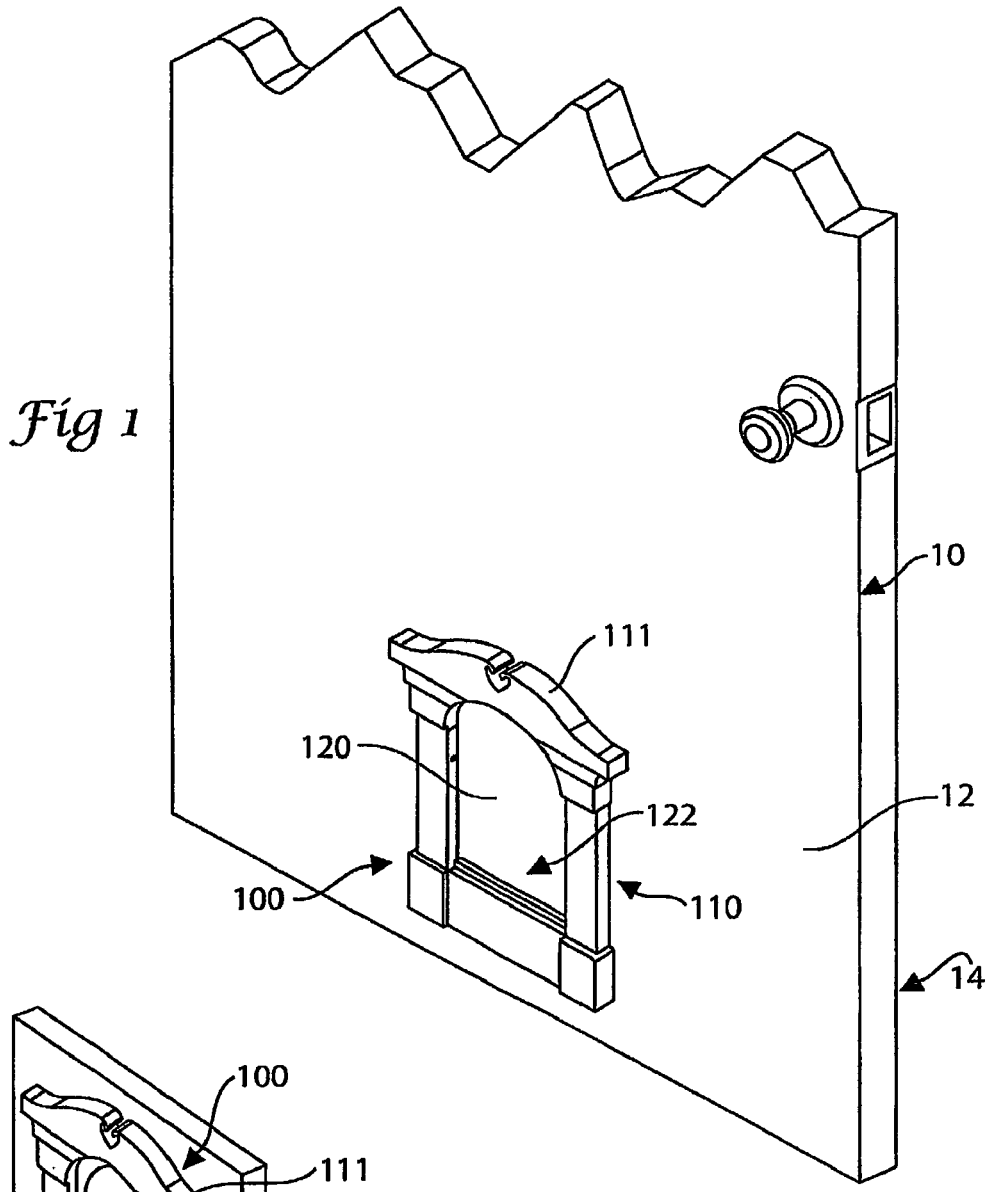
FIG. 1 shows a pet door, installed in a residence door, according to an embodiment that includes removable exterior decorative frames.
Figure 2:
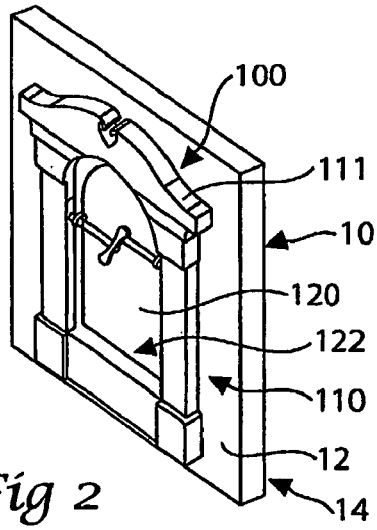
FIG. 2 shows a pet door according to an embodiment that includes removable exterior decorative frames, a security panel and interior deadbolt.
Figures 3, 3A:
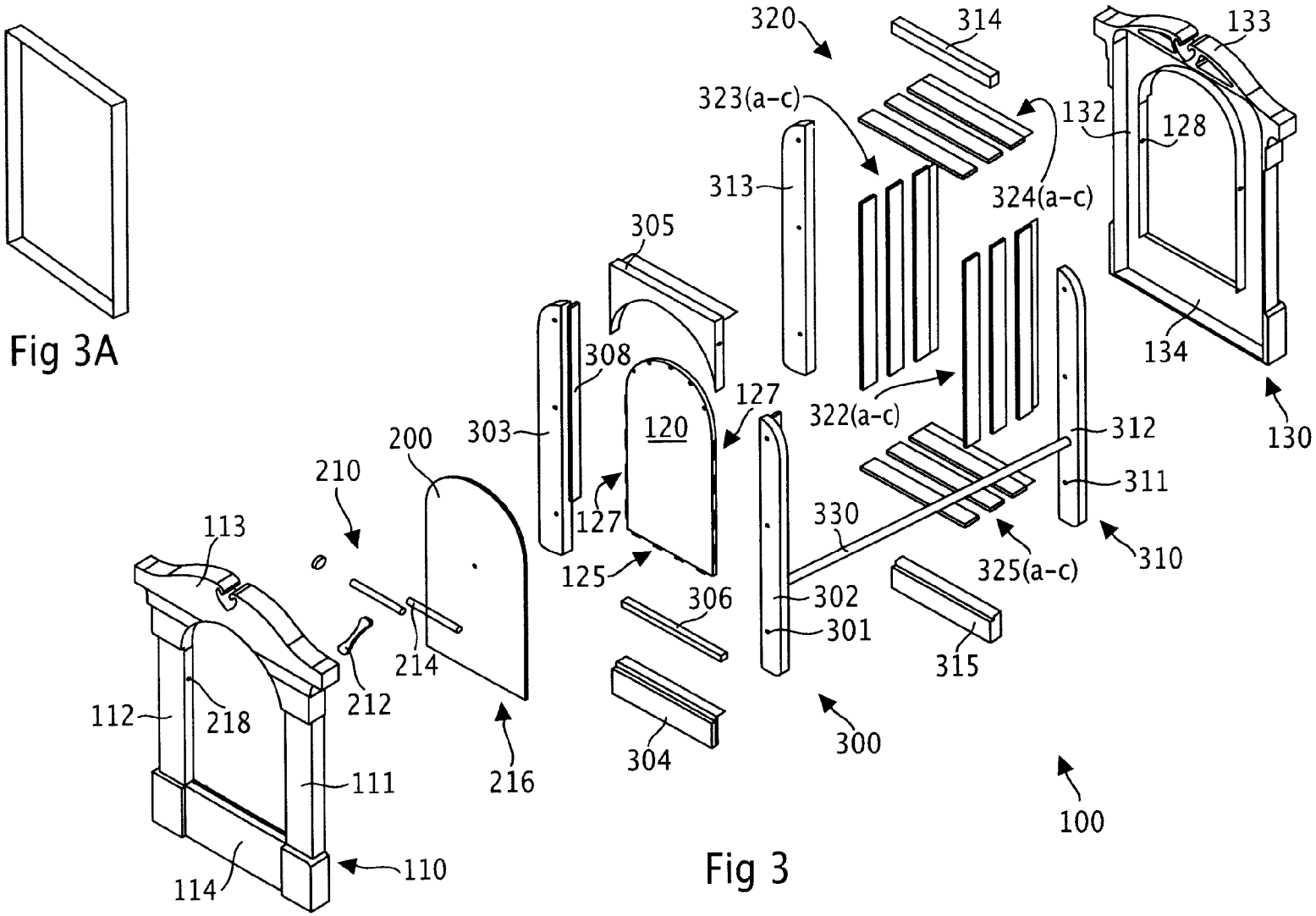
FIG. 3 is an exploded view of a pet door according to an embodiment.
FIG. 3A shows another embodiment of the core frame.

Referring to FIG. 1, a pet door 100 includes at least one removable exterior decorative frame 110 and a moveable flap 120, which can be made primarily of plastic, vinyl rubber and/or suitable flexible materials. The top of the flap 120 is mounted to a subframe (as illustrated in FIG. 3) of the pet door 100 and can be moved by the pet to allow the pet to enter and exit the residence through a passageway 122 formed within an aperture through the residence door 10. Although the specification speaks of the invention with reference to its installation in a residence "door," it should be generally understood to those of skill in the art that residence door 10 is intended by the inventors in a broad sense to include a wall or other portion of residence or dwelling into which pet door 100 could be installed. In the illustrated embodiment, the top of the flap 120 has a curved or arcuate shape. As discussed with reference to FIG. 10B, this arcuate shape can facilitate the opening and sealing of the sides and bottom of the flap 120. Other shapes may be utilized for the flap 120 depending on, for example, the shape of the decorative frame and subframe.

For reference, and not limitation, a side 12 of the residence door 10 is referred to as the interior side, and side 14 of the residence door 10 is referred to as the exterior side. For purposes of explanation, an "exterior" decorative frame is intended to refer to a decorative frame 110 that is placed onto or over a subframe element or assembly adjacent the face of the residence door 10 on the exterior of the residence door 10. The decorative frame 110 can be used on the inside, outside or both the inside and outside of the residence door 10.

Referring to FIGS. 2 through 4, 6A, 6B, and 11A-D the pet door 100 may optionally include a security door or panel 200. When the pet door is not in use, the security panel 200 may be placed across the passageway 122, thereby substantially sealing the passageway 122, and then may be locked in place, thereby substantially preventing intruders, children and animals from entering the residence through the pet door 100. The security panel 200 is secured in place over the passageway 122 by a locking mechanism 210. In one embodiment, the locking mechanism 210 includes a handle 212 and bolts 214 (hereinafter referred to as bolts, slides or posts). In use, the locking mechanism 210 is actuated by twisting the handle 212, thereby extending the slidable bolts 214 into and out of a portion of the pet door such as holes 218 (FIG. 4), thus respectively locking or unlocking the security panel 200, as needed. Persons skilled in the art will appreciate that other locking mechanisms 210 can be utilized, and other configurations e.g. vertically positioned bolts and/or reinforced holes. FIG. 3 illustrates the components of an embodiment of the pet door 100 that is assembled to sandwich the interior and exterior of the residence door 10. As illustrated, the pet door 100 includes the decorative frame 110 and security door 200 that are inside the residence, an exterior decorative frame 130 that is outside the residence, locking mechanism 210, and the movable flap 120. The pet door 100 includes subframe assemblies 300 and 310, which are connected to each other with a fastener 330. The fastener extends between the subframe assemblies 300 and 310, through the aperture formed in the residence door 10. Thus, unlike known pet doors, it is not necessary to drill or form separate fastening holes in or through the residence doors to attach the pet door 100, thus eliminating ancillary damage to the residence door 10 and otherwise simplifying installation of the pet door.

The fastener may be inserted through passageway 122 in the aperture of residence door 10 through holes 301 (in subframe 300) and into or through holes 311 (in subframe 310), thereby securing the subframe assemblies 300 and 310 together. The fastener is tightened so that the subframe assemblies 300 and 310 are cooperatively tightened to each other against the opposing, respective sides of residence door 10 which is sandwiched in between. In this manner, the subframe assembly 300 is attached to the interior side 12 of the residence door 10 and the subframe assembly 310 is attached to the exterior side 14 of the residence door 10. The entire pet door assembly not including the decorative frames 110 and 130, is fixed or non-removable until it is to be dismantled and removed from the residence door 10.

As shown, the subframe assembly 300 is a modular assembly and includes individual subframe frame elements: two side subframe elements 302 and 303, a top subframe element 305, and a bottom subframe element or threshold 304. The threshold 304 includes a vertically moveable sill 306 that can engage the bottom of the movable flap 120. The flap 120 is attached or secured to the top subframe element 305 of the subframe assembly 300. Similarly, the subframe assembly 310 is also a modular assembly and includes: two side subframe elements 312 and 313, a top subframe element 314 and a bottom subframe element 315.

A core frame assembly 320 is provided for placement around the interior of the passageway 122 formed in an aperture in the residence door 10 toward framing same. The core frame assembly 320 is also a modular assembly and includes: side core frame members 322 and 323, a top core frame member 324 and a bottom core frame member 325. In an embodiment, the core frame members 322 through 325 are pull-off or severable members and that are joined side-by-side one another to form a rectangular core or tunnel that extends laterally through the aperture formed in the residence door 10, thereby forming a passageway 122 through which a pet can more safely pass. As shown, each core frame member includes one or more core frame elements, e.g., 322*a-c*, 323*a-c*, 324*a-c*, 325*a-c*. As would be understood by those of ordinary skill in the art having the present specification before them the width of each core frame element and the number of core frame elements may be adjusted to accommodate varying residence door (or wall) thicknesses, widths, heights and/or pet owner needs.

The core frame elements (325*a-c*) of any one of the severable frame members are separate and independent of each other. That is, the core frame elements (325*a-c*) of one severable frame member are slidably joined to respective adjacent core frame elements of a neighboring core frame element. In an embodiment, the core frame members (322*a* through 325) are substantially flush or aligned with the inner surface of residence door 10 that defines the aperture, thereby forming the passageway 122 (although such a flush or aligned configuration is not required).

As illustrated in FIGS. 3 through 5, 7, and 11, the edges of the modular core frame elements 325(*a-c*) can be configured with "tongue and groove" designs so that one core frame element (325*a-c*) can be releasably attached (e.g., slidably attached) to another core element (325*a-c*), thereby forming core frame member 325, and a longer (wider) core or tunnel.

The number of core frame elements 325(*a-c*) that are attached and that laterally extend through the door aperture can be adjusted to accommodate thicker or thinner doors and/or varying pet heights. In other words, additional core frame elements 325(*a-c*) can be used to form a passageway 122 through thicker doors, whereas fewer core frame elements 325(*a-c*) can be used with thinner doors. In the illustrated embodiment, a core frame 320 includes four core frame members 322 through 325, each core frame (322 through 325) member having three core frame elements (322(*a-c*), 323(*a-c*), 324(*a-c*), 325(*a-c*)), attached side-by-side with "tongue and groove" connectors. Other methods and means of modular connection of core frame and subframe elements may also be used in conjunction with, or as an alternative to, the tongue and groove connectors. Alternately, as shown in FIG. 3A, core frame elements 322 to 325 may be combined to form a one piece core frame.

In the illustrated embodiment, the core frame member 325 are arranged in a square or rectangular design. Persons skilled in the art having this specification before them will appreciate that the number of core frame elements 325(*a-c*) necessary to cover the inner surface of the aperture in the residence door 10 can vary, and that a core frame member 325 having three core frame elements is provided for purposes of explanation, not limitation. Other members of core frame element 325(*a-c*) may be used, e.g. 2, 4, 5, 6, 7, etc. Persons skilled in the art having specification before them will appreciate the shape of the core frame may also be a matter of taste.

Figure 4:
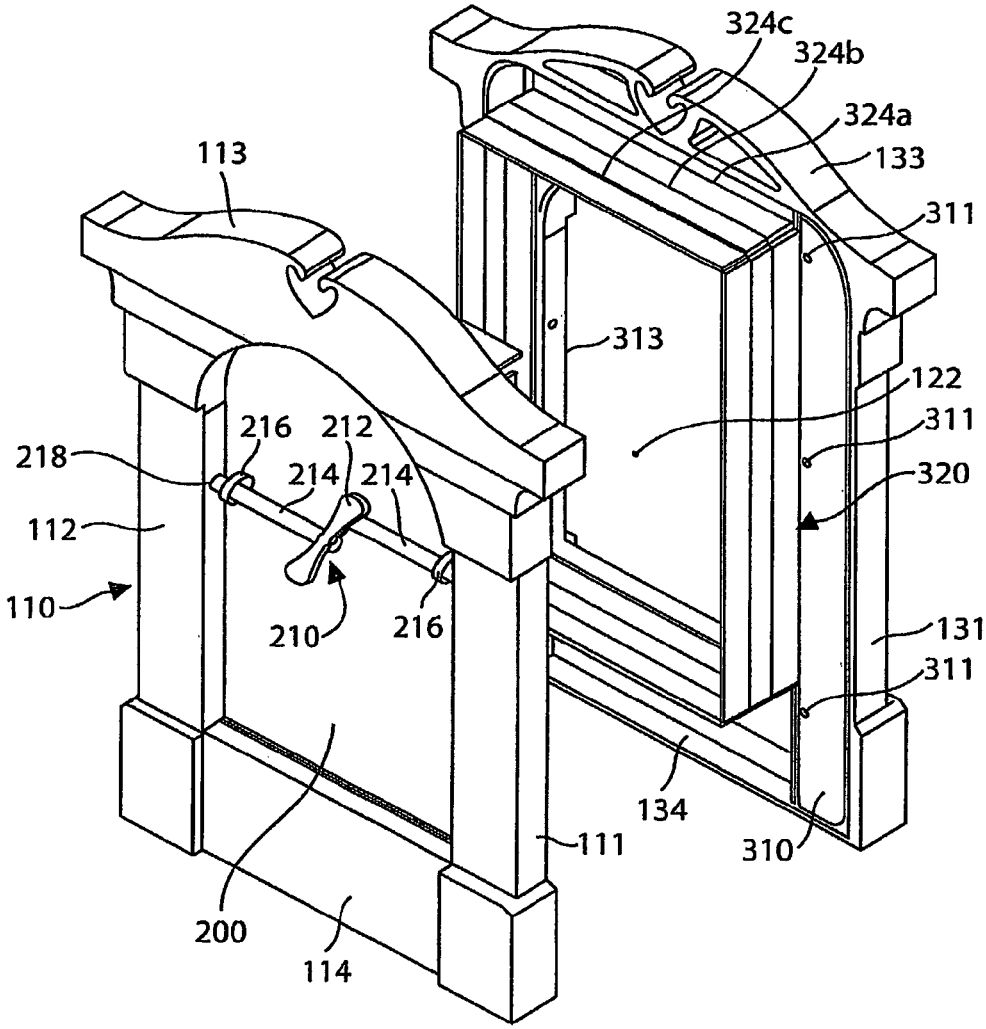
FIG. 4 illustrates opposing alignment of interior and exterior pet door subframe assemblies with security panel to be mounted from opposite sides of the pet owner's door.
Figure 5:
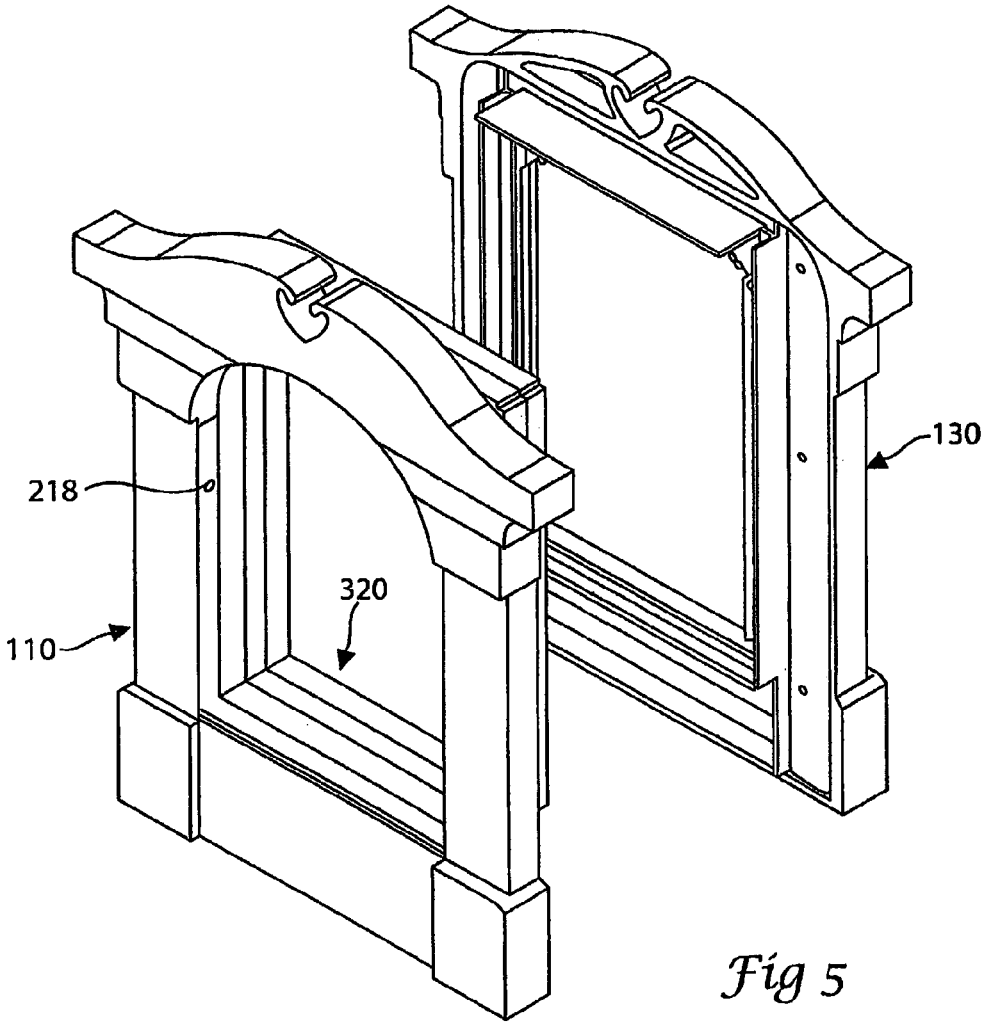
FIG. 5 further illustrates oppositely aligned exterior and interior pet door subframe assemblies.
Figure 6A:
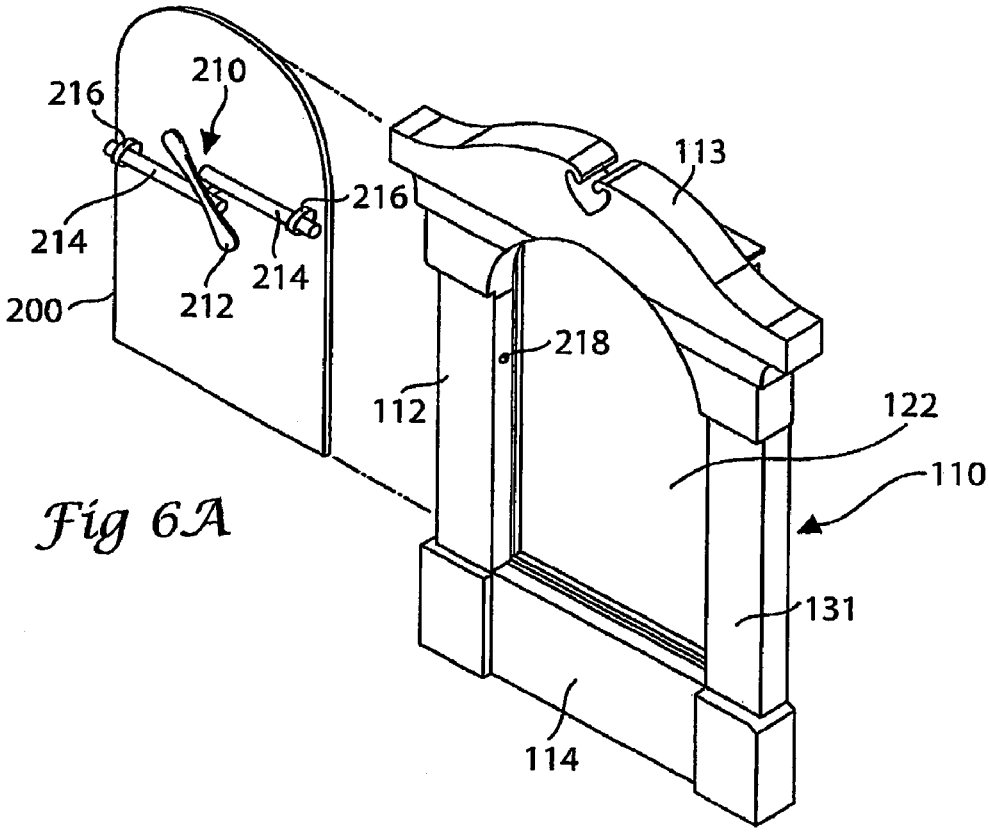
FIGS. 6A-B illustrate an interior security panel and deadbolt lock arrangement according to an embodiment.
Figure 6B:
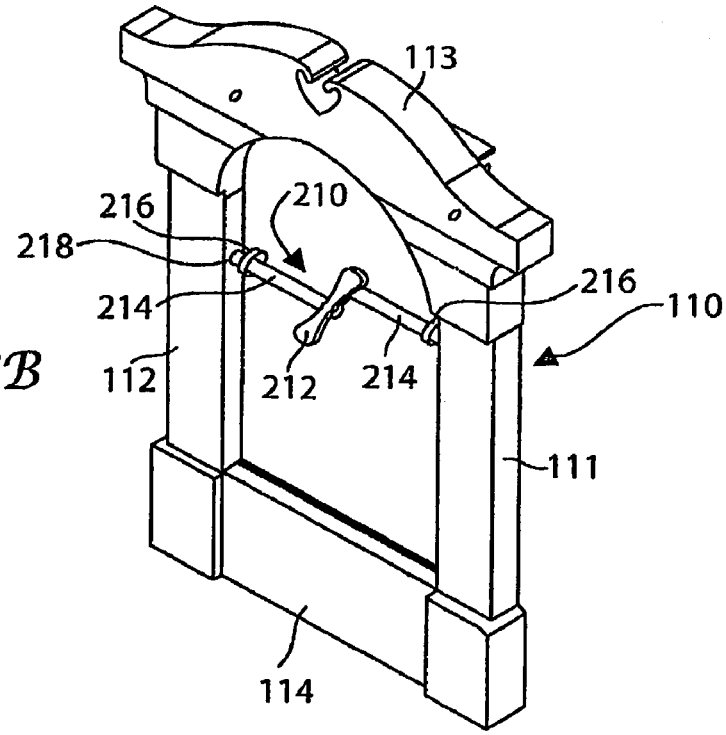
Figure 7:
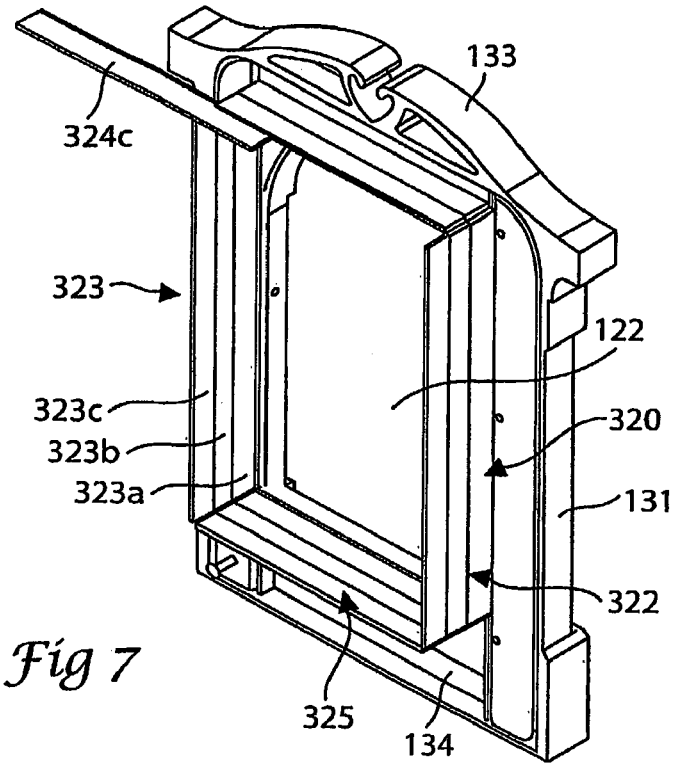
FIG. 7 illustrates a subframe assembly and core frame having core frame elements.
Figure 8:
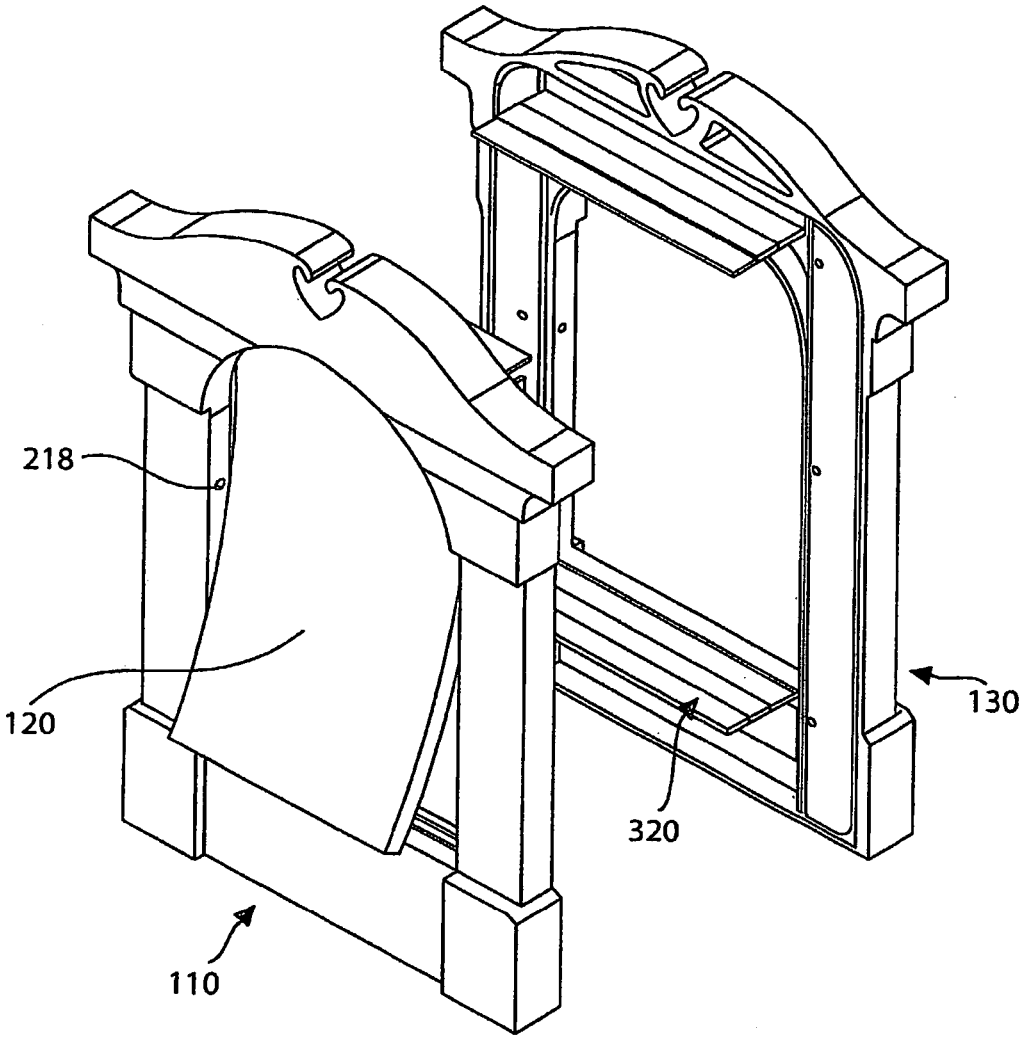
FIG. 8 illustrates a pet door with a movable flap attached to a subframe assembly.

As shown in FIGS. 4, 7, and 8, a first core frame element is releasably attached to a subframe assembly 310 (e.g., via either a sliding or a tongue and groove arrangement), and additional core frame elements 325 (*a-c*) can be attached to the first core frame element 325 to form a core frame assembly 320 with the desired length to accommodate residence doors 10 of different thicknesses. More particularly, the core frame assembly 320 extends between subframe assemblies 300 and 310 so as to extend through the aperture that is cut in the residence door 10.

In contrast to known pet door configurations, with the pet door 100 described and illustrated herein, it is not necessary to mount or attach core frame elements 325 (*a-c*) to each other or to another component since each core frame element 325 has a tongue that releasably slides into a groove formed in the subframe assembly 310, and additional core frame elements 325 (*a-c*) are then slidably and releasably attached to the previous core frame element 325 (see FIG. 7). The other subframe assembly 300 includes a groove for receiving edges of the assembled core frame element 325. The assembled core frame element 325 is then squeezed or held between the subframe assemblies 300 and 310, which are fastened to each other through the aperture formed in the residence door. Still, there are no further mechanical fasteners (e.g. screws, nails, etc.) that mount or fasten core frame elements to each other or to any subframe assembly. This configuration eliminates the need for users to fasten interior or middle pet door components together, thereby allowing for easier and faster installation with fewer mechanical fasteners.

The other subframe assembly, e.g., subframe assembly 300, is configured to secure the flap 120. As illustrated, the flap 120 is mounted, fastened or adhered to the top subframe 305 of the subframe assembly 300. The middle and bottom sections of the flap 120 can be moved side-to-side (i.e. inward and outward) by a pet. The subframe 305 that is attached to the flap 120 also includes the threshold 306.

More particularly, a bottom subframe element 304 includes a threshold or sill 306 that is composed of, or includes, a magnetic element or ferrous magnetically active material. Suitable thresholds that can be used are described in U.S. Pat. Nos. 4,651,793 and 4,408,416, the disclosures of which are incorporated herein by reference. In one exemplary threshold, the bottom edge of the flap 120 includes one or more magnets 125. As a result, when the bottom edge of the flap 120 is adjacent to the threshold 304, the threshold magnet 306 will rise up or be attracted to the magnets 125 in the bottom edge of the flap 120, thereby substantially sealing the bottom of the passageway 122 formed in the aperture of the residence door 10.

Figure 9:
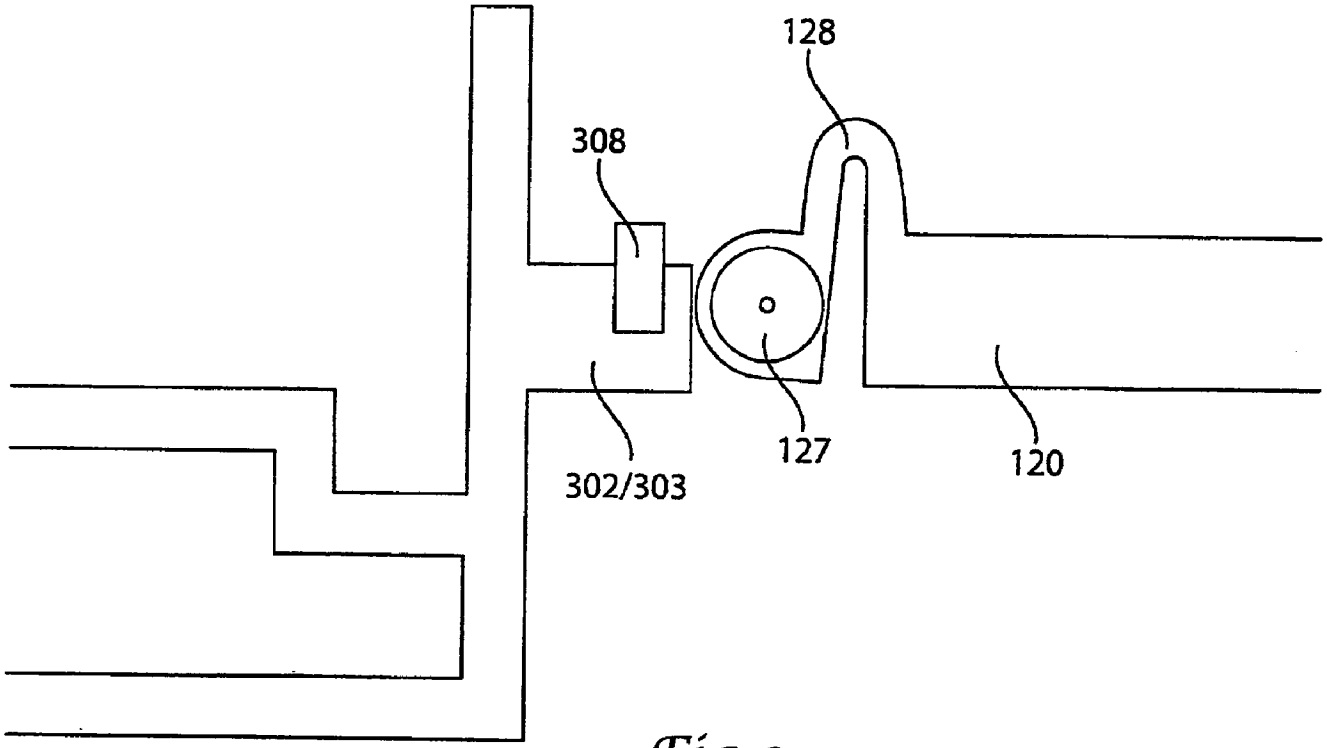
FIG. 9 illustrates a magnetic component of a side of a movable flap being attracted to a subframe assembly.

Similarly, as shown in FIGS. 3, 9, 10A and 10B, the edges or sides of the flap 120 may also include magnets or ferrous magnetically active materials 127, such as separate magnets, integrated magnetic materials, or magnetic chains, which can be attracted to magnets or magnetic sections 308 of the side subframes 302 and 303, thereby sealing the sides of the passageway 122 As shown in FIG. 9, the side of the flap 120 may include a flexible elbow, rib or U-shaped member 128. When the magnets 127 and 308 are separated by a sufficient distance, e.g., when the flap 120 is opened, the member 128 assumes an unextended or relaxed position. As the flap 120 is being closed, and the magnets 127 and 308 approach each other, the member 128 extends outwardly from the relaxed position to an extended position due to the attraction between magnets 127 and 308, thereby providing a "living" or adjustable hinge that seals the sides of the passageway 122 between the subframe 300 and the residence door 10 and provides a comprehensive seal when the flap 120 is at a rest or closed position.

Figure 10A:
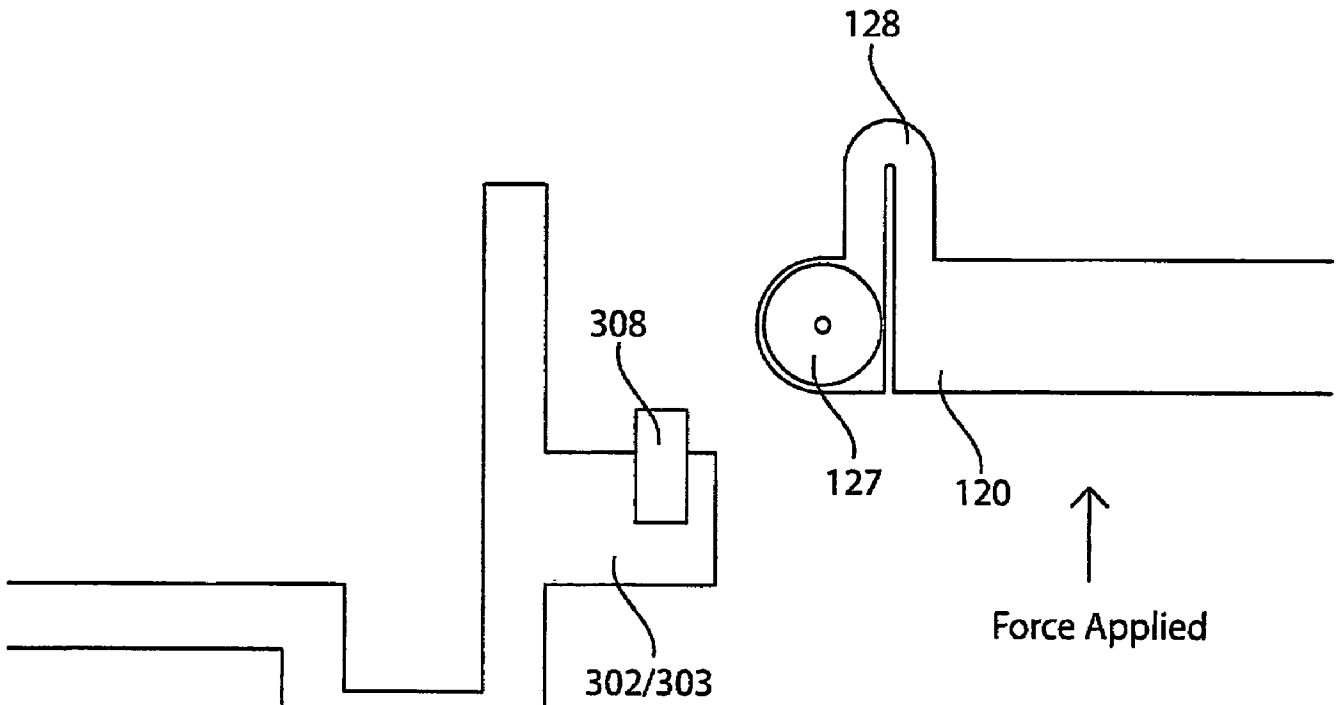
FIG. 10A illustrates a magnetic component of a side of a movable flap being separated from a subframe assembly.
Figure 10B:
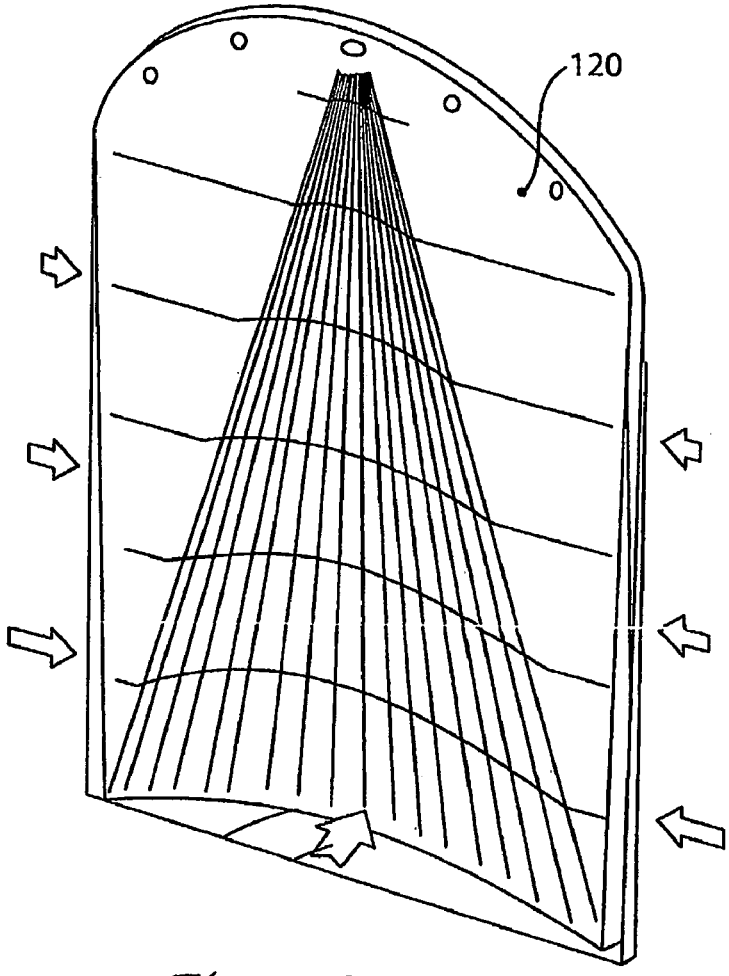
FIG. 10B further illustrates deflection or tapering of an arcuate shaped flexible flap as a force is applied to the flap.
Figure 11:
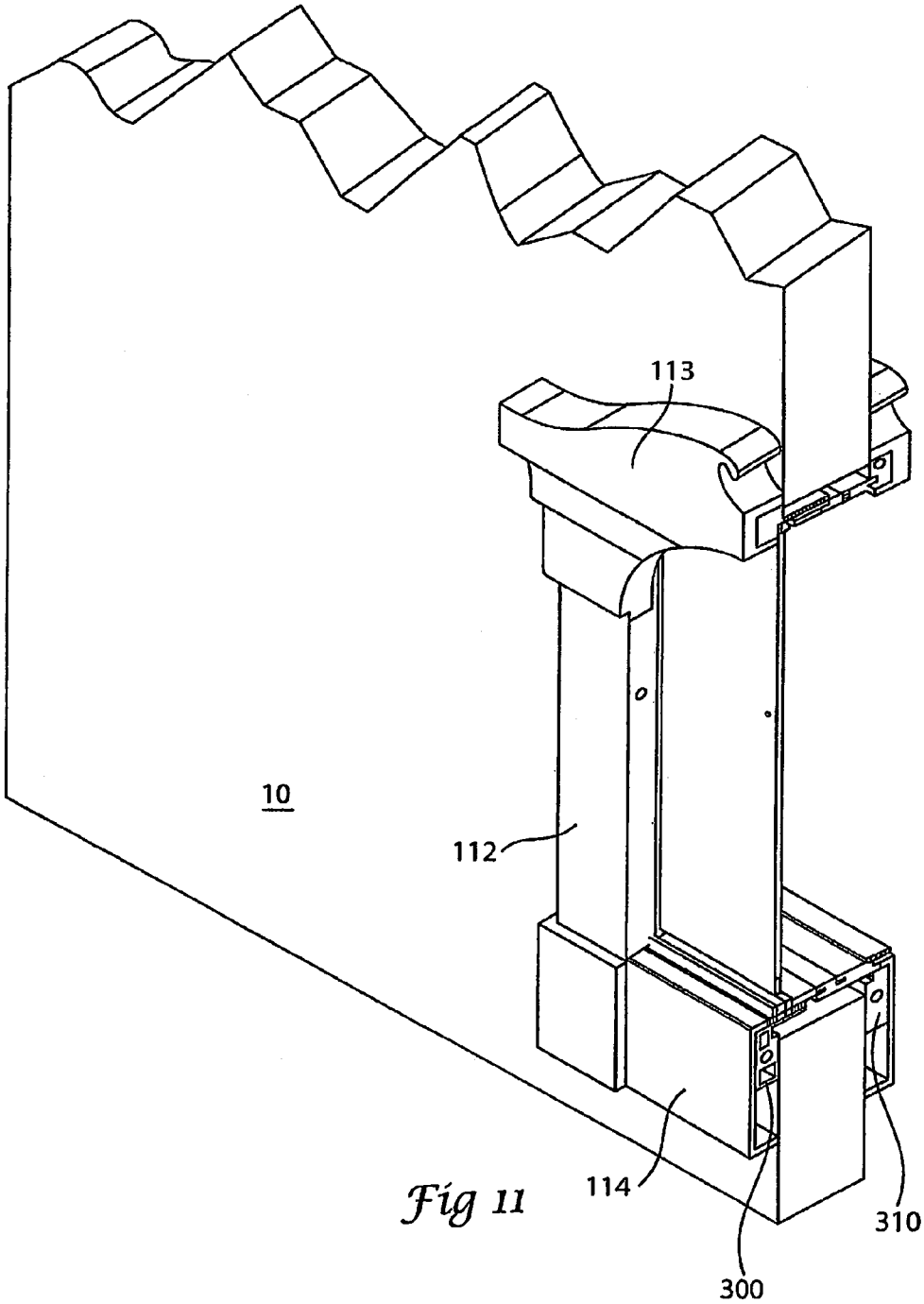
FIG. 11 is a cross section view illustrates an installed pet door.

Further, in the illustrated embodiment, as shown in FIGS. 3, 8 and 10B the top edge of the movable flap 120 may have a curved or arcuate shape. The top of the flap 120 includes holes through which fasteners are inserted to secure the flap 120 to the subframe assembly 300, in particular, the top subframe element 304.

Referring to FIG. 10B, in this preferred embodiment, as the movable flap 120 is forced open by a pet pushing against the flap 120, the side edges of the flap 120 taper inwardly about a central vertical axis so that the flap 120 flexes to assume a conical-like shape. When the flap 120 moves back to its home or sealed position, the taper or conical shape recedes, and the flap 120 returns to its initial substantially flat shape. This tapering action facilitates separation of the magnetic elements 308 in the subframe 300 and magnetic components 127 in the sides and bottom of the flexible flap 120 as the flap 120 is pushed open, while allowing the flap 120 to be sealed in its substantially flat configuration when at rest.

If necessary, a security panel 200 can be placed over the passageway 122. As shown in FIGS. 2, 4, 6A, and 6B, a locking mechanism 210 can be used to reliably retain the security panel 200 in place and deny access to the opening through the interior pet door section. In the illustrated embodiment, the locking mechanism 210 includes posts 214 and a handle or arm 212. The security panel 200 can be locked from inside the residence or from outside the residence. For purposes of explanation and illustration, not limitation, this specification describes a security panel 200 that is installed from the inside of the residence.

The posts or bolts 214 supported by guides 216 on the panel 200, and are moved in and out of slots 218 (also referred to as holes or apertures) formed in the sides of the exterior decorative frame 110, the slidable posts 214 that are supported by respective guides 216 located at opposite sides of security panel 200. The slidable movement of the posts 214 relative to guides 216 is controlled by a rotatable locking arm 212 that is manually manipulated by the pet owner when security panel 200 is removed from or returned to the pet door 100 or locked in place. In the depicted embodiment, when the pet owner rotates the locking arm 212 in a first (e.g., clockwise) direction, the posts 214 of locking mechanism 210 are correspondingly advanced outwardly and away from one another through respective guides 216, through the decorative frame 100, and into the subframe assembly 300. When the posts 214 are advanced into holes 218, a deadbolt type lock is established to prevent the unauthorized detachment of security panel 200. As is known, these holes 218 may be reinforced or extended into subframe 300 to add further security.

In the depicted embodiment, when the pet owner rotates the locking arm 212 in an opposite (e.g., counter-clockwise) direction, the posts 214 are correspondingly retracted inwardly towards one another via respective guides 216. The posts 214 are therefore withdrawn from the holes 218, the locking mechanism 210 is unlocked so that the security panel 200 can now be detached and allow the pet to move through the passageway 122.

After the subframe assemblies 300 and 310 and core frame 320 are assembled and fixed about the residence door 10, exterior decorative frames 110 and 130 can be placed over or onto the subframe assemblies 300 and 310, thereby completing assembly of the aesthetically pleasing pet door 100 according to an embodiment.

More particularly an exterior decorative frame 110 is applied over the subframe assembly 300 and an interior decorative frame 130 is applied over the subframe assembly 310. The decorative frames 110 and 130 may be the same or different and can be interchangeable. For example, one decorative frame can have a particular color or colors, shape, and/or size to match the décor of the exterior of the residence, while the other decorative frame can be another color or colors, style, shape, and/or size to match the décor of the interior of the residence. The illustrated design of the decorative pet door frames 110 and 130 is provided for purposes of explanation and illustration, not limitation. Thus, unlike known pet doors, that typically include bland square frames that are screwed into the door embodiments of the present invention provide for aesthetically appealing pet doors that can be customized and changed as necessary.

The exterior decorative frames, 110 and 130 unlike the inner subframe assemblies 300 and 310 and core frame 320, are readily removable. For example, according to an embodiment, the decorative frames 110 and 130 can include grooves that are shaped and sized to slide over the tops of the subframe assemblies 300 and 310. The decorative frames 110 and 130 can also be attached to subframe assemblies with various fasteners, e.g. a "loop and hook" configuration. Thus, the decorative frames 110 and 130 can be removed, while the other pet door components, namely the subframe assemblies 300 and 310 and core frame 320, remain intact and fixed to the residence door 10.

In the illustrated embodiment, showing one example of a design of an exterior decorative frame, each decorative frames 110 and 130 includes a pair of upstanding columns 111 and 112 and 131 and 132 respectively that are disposed in spaced, parallel alignment. An integral cap 113 and 133 extends horizontally between the tops of columns, and an integral base 114 and 134 extends horizontally between the bottoms of columns. The upstanding columns 111, 112, 131, and 132, and the cap 113 and 133, and base 114 and 134 of the pet door decorative frame 110 section surround passageway 122 through which a pet can leave and enter its owner's residence.

Figure 12:
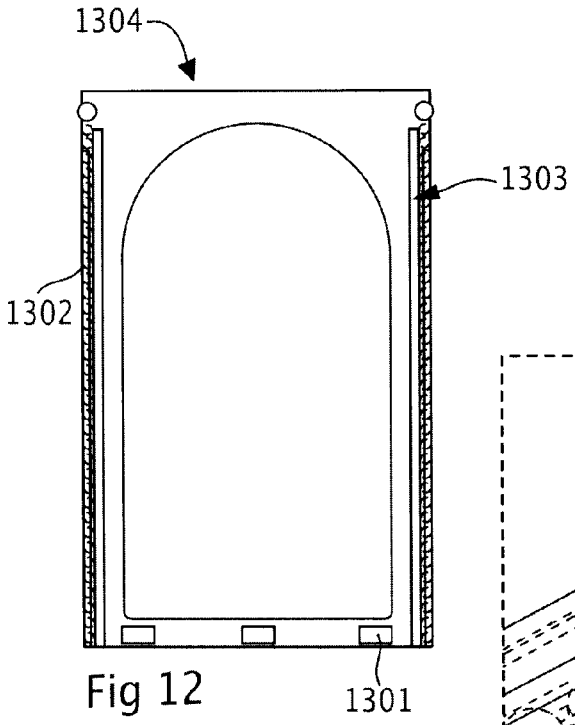
FIG. 12 illustrates an embodiment of a movable flap for use in a pet door.
Figure 14:
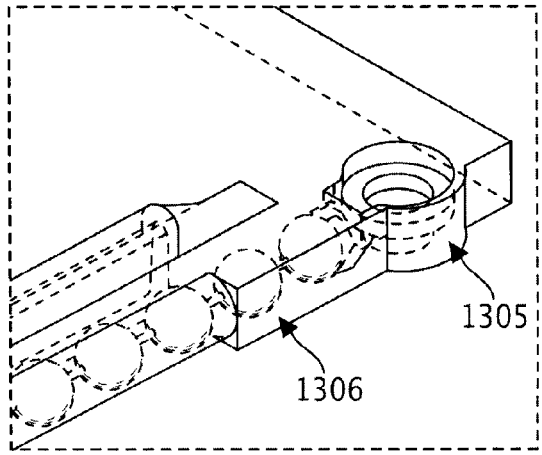
FIG. 14 is an enlarged cross sectional view of a movable flap for use in a pet door according to an embodiment.
Figure 13:
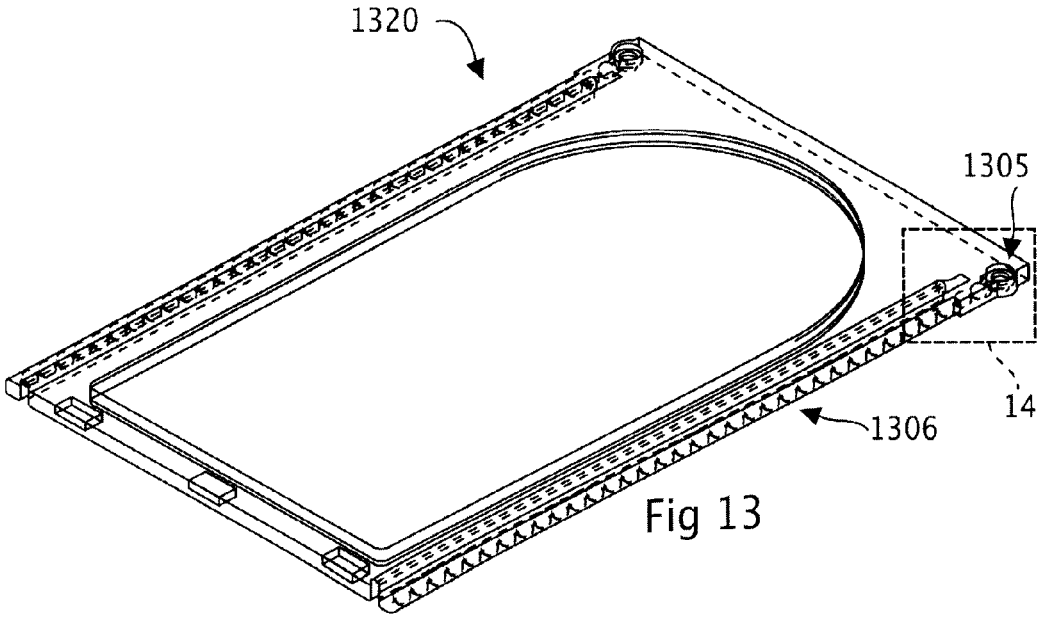
FIG. 13 is a perspective view of a movable flap for use in a pet door according to an embodiment.

In the embodiment in FIGS. 12-14, one example of a flexible flap 1320 is illustrated. The flexible flap 1320 has a bottom edge 1301, side edges 1302 and 1303 and a top edge 1304. A cross-section taken at x of the side edge 1302 of the flexible flap 1320 reveals an anchor element 1305 and a side edge including a plurality of magnetically-attractive elements 1306 tied from the anchor element 1305 to form a chain. While this anchor element/plurality of elements 1306 aids in manufacturing, it would be possible to insert a loose plurality of magnetically-attractive elements during the molding process. The flexible flap opens and returns to sealed position as described in FIG. 10B.

Persons skilled in the art having this specification before them will appreciate that the decorative frames can be attached to a subframe assembly as well as attached to a residence door. Further, persons skilled in the art will appreciate that the decorative frames can cover different portions of a subframe assembly, e.g., substantially all or all of a subframe assembly. Additionally, persons skilled in the art will appreciate that a decorative frame can be attached directly to a residence door.

The invention claimed is:

1. A pet door comprising:

a first subframe assembly disposed on one side of an aperture;

a second subframe assembly disposed on another side of the aperture opposite the one side of the aperture;

a fastener attached to said first and second subframe assemblies and extending through the aperture, said fastener connecting said first and second subframe assemblies together such that tightening said fastener draws said first and second subframe assemblies towards one another to fix said subframe assemblies relative to the aperture; and a plurality of core frames, said plurality of core frames including fastening means for removably attaching said plurality of core frames to one another and to said first and second subframe assemblies, wherein said core frames extend laterally between said first and second subframe assemblies and within the aperture and define a polygonal passageway through which a pet can pass, and wherein said core frames are sandwiched by and held in the aperture between said first and second subframe assemblies and wherein said fastener does not extend through said core frames.

2. The pet door of claim 1 further comprising:

a flap for substantially covering the passageway, said flap hingedly connected to one of the first subframe assembly and the second subframe assembly.

3. The pet door of claim 2, wherein the flap is formed of a flexible material.

4. The pet door of claim 2, wherein the flap has a first magnetic element and at least one of the first and second subframe assemblies has a second magnetic element such that said first and second magnetic elements attract one another to urge said flap into a closed position.

5. The pet door of claim 4, wherein the flap includes a flexible rib connecting the first magnetic element to said flap, the flexible rib enables said first magnetic element to move between extended and relaxed positions as a result of interaction with said second magnetic element as said flap moves between said closed position and an open position.

6. The pet door of claim 4, wherein the pet door further includes a decorative frame, the decorative frame being releasably secured to one of the subframe assemblies, whereby said decorative frame can be removed from the one of the subframe assemblies, while the subframe assemblies remain fixed to each other.

7. The pet door of claim 6, further including a security panel, the security panel being removably placed in the pet door to block passage through said passageway.

8. The pet door of claim 7, wherein the security panel includes a lock mechanism, the lock mechanism including bolts to lock the security panel relative to the pet door.

9. The pet door of claim 6, further including a second decorative frame which is identical to the first decorative frame.

10. The pet door of claim 6, further including a second decorative frame which is different from the first decorative frame.

11. The pet door of claim 4, wherein the first magnetic element comprises magnets on a side and a bottom of the flap, and the second magnetic element is on a bottom portion of the at least one of the first and second subframe assemblies.

12. The pet door of claim 4, wherein the first magnetic element is a chain.

13. The pet door of claim 1, wherein said fastening means comprises one of a tongue and a groove.

14. The pet door of claim 1, wherein each of the plurality of core frames includes a bottom core frame element.

15. The pet door of claim 1, wherein each of the core frames comprises a first side core frame element; a second side core frame element; a top core frame element; and a bottom core frame element.

16. The pet door of claim 1, further including a flexible flap having an arcuate top edge.

17. The pet door of claim 16, wherein side edges of the flexible flap move inwardly as the flexible flap is moved from a closed position, thereby facilitating separation of magnetic elements of the side edges of the flap and of one of the first and second subframe assemblies.

18. The pet door of claim 1, wherein the first and second subframe assemblies apply a pressure to the core frames.

19. A pet door comprising:

a first subframe assembly disposed on one side of an aperture;

a second subframe assembly disposed on another side of the aperture opposite the one side of the aperture;

a fastener attached to said first and second subframe assemblies and extending through the aperture, said fastener connecting said first and second subframe assemblies together such that tightening said fastener draws said first and second subframe assemblies towards one another to fix said subframe assemblies relative to the aperture;

a plurality of core frames, said plurality of core frames including fastening means for removably attaching said plurality of core frames to one another and to said first and second subframe assemblies, wherein said core frames extend laterally between the first and second subframe assemblies and within the aperture and define a passageway through which a pet can pass, wherein the core frames are sandwiched by and held in the aperture between the first and second subframe assemblies, and wherein said fastener does not extend through said core frames; and wherein each of said plurality of core frames includes a first side core frame element, a second side core frame element, a top core frame element, and a bottom core frame element.

* * * * *

UNITED STATES PATENT AND TRADEMARK OFFICE

CERTIFICATE OF CORRECTION

PATENT NO. : 7,886,486 B2
APPLICATION NO. : 11/719845
DATED : February 15, 2011
INVENTOR(S) : Frederick K. Lomax, Linda G. McCallum and Clark Berg Foster It is certified that error appears in the above-identified patent and that said Letters Patent is hereby corrected as shown below:

ON THE TITLE PAGE:
ITEM (75) INVENTORS:
Please change inventor name "Linda G McCalum" to --Linda G. McCallum--.

Signed and Sealed this
Twentieth Day of September, 2011

David J. Kappos

David J. Kappos
*Director of the United States Patent and Trademark Office*